US009481952B2

(12) United States Patent
Lonati et al.

(10) Patent No.: US 9,481,952 B2
(45) Date of Patent: Nov. 1, 2016

(54) DOUBLE-CYLINDER CIRCULAR MACHINE FOR PRODUCING TUBULAR KNITTED MANUFACTURES, PARTICULARLY FOR MAKING HOSIERY ITEMS OR THE LIKE

(75) Inventors: Ettore Lonati, Botticino (IT); Fausto Lonati, Brescia (IT); Tiberio Lonati, Brescia (IT); Francesco Lonati, legal representative, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 350 days.

(21) Appl. No.: 14/345,299

(22) PCT Filed: Jul. 23, 2012

(86) PCT No.: PCT/EP2012/064383

§ 371 (c)(1),
(2), (4) Date: Nov. 17, 2014

(87) PCT Pub. No.: WO2013/041267

PCT Pub. Date: Mar. 28, 2013

(65) Prior Publication Data

US 2015/0096332 A1 Apr. 9, 2015

(51) Int. Cl.

| | |
|---|---|
| ***D04B 9/10*** | (2006.01) |
| ***D04B 15/16*** | (2006.01) |
| ***D04B 15/94*** | (2006.01) |

(52) U.S. Cl.

CPC ..... *D04B 9/10* (2013.01); *D04B 15/16* (2013.01); *D04B 15/94* (2013.01)

(58) Field of Classification Search

CPC ..... D04B 9/10; D04B 15/16; D04B 15/94
USPC ..... 66/148, 150, 18
See application file for complete search history.

(56) References Cited

U.S. PATENT DOCUMENTS 2,258,927 A 11/1937 Clarke
2,506,968 A * 5/1950 Oberholtzer ..... D04B 9/10 66/135

(Continued)

FOREIGN PATENT DOCUMENTS

CN 201155021 Y 11/2008
CN 201212088 Y 3/2009

(Continued)

OTHER PUBLICATIONS

Examination Report based on related Chinese application No. 201280054689.5, dated Feb. 11, 2015 (6 pgs.).

(Continued)

*Primary Examiner* — Danny Worrell
*Assistant Examiner* — Jocelyn Wu
(74) *Attorney, Agent, or Firm* — Husch Blackwell LLP

(57) ABSTRACT

A double-cylinder circular machine for producing tubular knitted manufactures, particularly for making hosiery items or the like, which comprises a supporting structure which is provided with a footing for resting on the ground which supports, so that it can rotate about its own vertically-oriented axis, a lower needle cylinder. The supporting structure comprises at least one column which is extended substantially vertically, protrudes upward from the footing and supports, so that it can rotate about its own axis, an upper needle cylinder, the upper needle cylinder is supported, so that it can rotate about its own axis, by an arm, which in turn is supported by the column, elements being provided for the rotation of the arm about the axis of the main shaft with respect to the column to provide the transition of the upper needle cylinder from an active position to an inactive position.

10 Claims, 5 Drawing Sheets

(56) References Cited

U.S. PATENT DOCUMENTS

| | | | | |
|---|---|---|---|---|
| 4,028,910 | A * | 6/1977 | Wignall | D04B 1/108 66/148 |
| 5,187,951 | A | 2/1993 | Stroud et al. | |
| 6,698,250 | B2 * | 3/2004 | Lonati | D04B 9/10 66/148 |
| 2001/0052248 | A1 * | 12/2001 | Ando' | D04B 9/56 66/148 |
| 2003/0233852 | A1 * | 12/2003 | Lonati | D04B 9/10 66/17 |

FOREIGN PATENT DOCUMENTS

| | | | |
|---|---|---|---|
| CN | 101809213 | A | 8/2010 |
| GB | 372 510 | | 5/1932 |
| GB | 2 288 819 | | 11/1995 |
| JP | 2009-79322 | A | 10/2010 |
| KR | 10-1003082 | B1 | 12/2010 |

OTHER PUBLICATIONS

English translation of Examination Report based on related Chinese application No. 201280054689.5, dated Feb. 11, 2015 (9 pgs.).

International Search Report and Written Opinion for related PCT Patent App. No. PCT/EP2012/064383 dated Oct. 5, 2012.

Search Report for related Italian Patent App. No. IT M120111681 dated Jul. 11, 2012.

* cited by examiner

DOUBLE-CYLINDER CIRCULAR MACHINE FOR PRODUCING TUBULAR KNITTED MANUFACTURES, PARTICULARLY FOR MAKING HOSIERY ITEMS OR THE LIKE

The present invention relates to a double-cylinder circular machine for producing tubular knitted manufactures, particularly for making hosiery items or the like.

As is known, double-cylinder circular machines for producing hosiery or tubular manufactures in general comprise a supporting structure which is composed substantially of a footing which rests on the ground and supports the lower needle cylinder so that it can rotate about its own axis, which is oriented vertically.

The footing also supports, by means of a column, which rises vertically from the footing, the upper needle cylinder, which is arranged above and coaxially with respect to the lower needle cylinder.

The actuation cams of the sliders are arranged around the lower needle cylinder and around the upper needle cylinder and are accommodated inside axial slots defined on the lateral surface of the needle cylinders. The sliders are adapted to engage respectively the lower tip or head or the upper tip or head of the needles of the machines, which are typically provided with a tip or head at both of their ends. The sliders are provided with heels which protrude from the lateral surface of the needle cylinder in which they are accommodated and can engage, as a consequence of the rotation of the needle cylinders about their own axis with respect to the actuation cams, paths defined by the actuation cams. These paths are shaped so as to cause the movement of the transfer sinkers with respect to the needle cylinders parallel to the axis of the needle cylinders. This movement of the sliders is used to actuate the needles, for example to move the needles to knit at a feed or drop of the machine, or to transfer the needles from the lower needle cylinder to the upper needle cylinder or vice versa.

The lower needle cylinder can be actuated with a rotary motion about its own axis by means of an electric motor which is accommodated within the footing and is connected by means of its shaft to the lower needle cylinder by means of a transmission with gears or a toothed belt. The same electric motor is connected to the upper needle cylinder so as to actuate the upper needle cylinder with a rotary motion about its own axis in a manner which is synchronized with the rotation of the lower needle cylinder. More precisely, the shaft of the electric motor accommodated in the footing is connected, by means of a transmission with sprockets or a toothed belt, to a transmission shaft which is supported, so that it can rotate about its own vertically oriented axis, within the column that supports the upper needle cylinder. The transmission shaft is connected, proximate to its upper end, to the upper needle cylinder by means of a transmission with sprockets or a toothed belt.

In recent years, the gradual establishment of methods for automatically closing an axial end of tubular manufactures provided with these machines has given rise to the need to shift the upper needle cylinder laterally with respect to the lower needle cylinder at the end of the production of the manufacture, in order to pickup the manufacture by means of a pick-up device.

Many of these methods are based on the use of a pick-up device which, in its application to single-cylinder circular machines, is arranged coaxially around the upper end of the needle cylinder or directly above the upper end of the needle cylinder. This pick-up device is provided with pick-up elements, each of which can engage a needle of the machine so as to pick up the loop of the last row of knitting formed thereby and retained in its tip or head at the end of the production of the manufacture.

These pick-up devices can also be used to pick up the manufacture produced on double-cylinder circular machines and retained by the needles arranged in the lower needle cylinder, but in order to be arranged above or around the upper end of the lower needle cylinder they require the upper needle cylinder to be moved away upward or shifted laterally with respect to the lower needle cylinder.

In order to perform this movement of the upper needle cylinder, devices have been proposed which are based on mounting the upper needle cylinder on a support which can move with respect to the footing of the machine due to the action of additional actuation means.

These devices of a known type complicate the mechanical aspects of the machine and have an operation that is not always fully satisfactory.

The aim of the present invention is to solve the problem described above, by providing a double-cylinder circular machine for producing tubular knitted manufactures, particularly for producing hosiery items or the like, in which it is possible to move simply and precisely the upper needle cylinder laterally with respect to the lower needle cylinder, in particular to allow the positioning, above or around the upper end of the lower needle cylinder, of a pick-up device which is capable of performing the automated pick-up of the manufacture from the needles of the machine at the end of its production.

Within this aim, an object of the invention is to provide a double-cylinder circular machine in which the device used to move the upper needle cylinder with respect to the lower needle cylinder has a minimal space occupation, such as to not hinder the installation of the other devices with which the machine is equipped.

Another object of the invention is to provide a double-cylinder circular machine that ensures in any case, with high precision, the correct positioning of the upper needle cylinder with respect to the lower needle cylinder in the production of the manufactures.

A further object of the invention is to propose a double-cylinder circular machine that can be manufactured with competitive costs and has high reliability in operation.

This aim, as well as these and other objects which will become better apparent hereinafter, are achieved by a double-cylinder circular machine for producing tubular knitted manufactures, particularly for making hosiery items or the like, comprising a supporting structure which is provided with a footing for resting on the ground which supports, so that it can rotate about its own vertically-oriented axis, a lower needle cylinder, said supporting structure comprising at least one column which is extended substantially vertically, protrudes upward from said footing and supports, so that it can rotate about its own axis, an upper needle cylinder which is arranged above said lower needle cylinder, means being provided for the actuation of said lower needle cylinder and of said upper needle cylinder with a rotary motion about their axes; said actuation means comprising a main motor, which is connected kinematically to said lower needle cylinder and to said upper needle cylinder by means of a main shaft, which is arranged within said column and is oriented so that its axis is vertical, characterized in that said upper needle cylinder is supported so that it can rotate about its own axis by an arm, which in turn is supported by said column so that it can rotate about the axis of said main shaft, means being provided for the rotation of said arm about the axis of said main shaft with respect to said column for the transition of said upper needle cylinder from an active position, in which it is arranged coaxially to said lower needle cylinder, to an inactive position, in which it is spaced with its axis laterally to the axis of said lower needle cylinder, and vice versa, said rotation means being constituted by said main motor.

Further characteristics and advantages of the invention will become better apparent from the description of a preferred but not exclusive embodiment of the machine according to the invention, illustrated by way of non-limiting example in the accompanying drawings, wherein.

Figure 1:
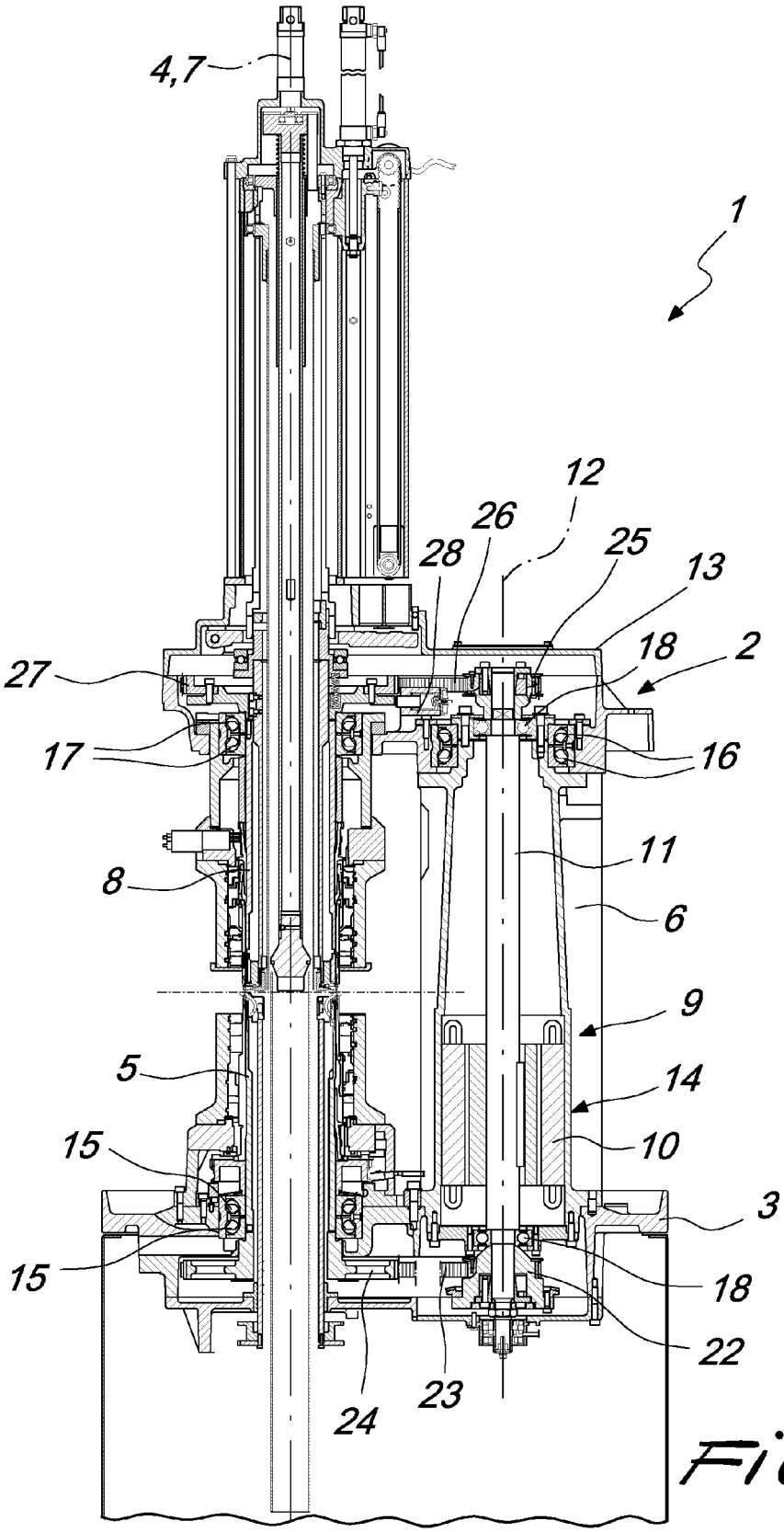
FIG. 1 is a schematic sectional view of the machine according to the invention, taken along a vertical plane that passes through the axis of the lower needle cylinder and of the upper needle cylinder in a coaxial position.

With reference to the figures, the machine according to the invention, generally designated by the reference numeral 1, comprises a supporting structure 2 which is provided with a footing 3 for resting on the ground and supports, so that it can rotate about its own axis 4, which is oriented vertically, a lower needle cylinder 5. The supporting structure 2 also comprises a column 6 which is extended substantially vertically, rises upward from the footing 3 and supports, so that it can rotate about its own axis 7, which is also oriented vertically, an upper needle cylinder 8 which is arranged above the lower needle cylinder 5.

The machine comprises means 9 for actuating the lower needle cylinder 5 and the upper needle cylinder 8 with a rotary motion about the corresponding axes 4, 7. The actuation means 9 comprise a main motor 10, which is connected kinematically to the lower needle cylinder 5 and to the upper needle cylinder 8 by means of a main shaft 11, which is arranged laterally to the column 6 and is oriented so that its axis 12 is vertical.

According to the invention, the upper needle cylinder 8 is supported, so that it can rotate about its own axis 7, by an arm 13, which in turn is supported by the column 6 so that it can rotate about the axis 12 of the same main shaft 11. The machine is provided with means 14 for the rotation of the arm 13 about the axis 12 of the main shaft 11 with respect to the column 6 in order to actuate the transition of the upper needle cylinder 8 from an active position, in which it is arranged coaxially to the lower needle cylinder 5, to an inactive position, in which its axis 7 is spaced laterally to the axis 4 of the lower needle cylinder 5, and vice versa. The rotation means 14 for actuating the transition of the upper needle cylinder 8 from the inactive position to the active position or vice versa are constituted by the same main motor 10.

More precisely, the footing 3 supports, so that it can rotate about its own axis 4, the lower needle cylinder 5 by means of a pair of bearings 15.

The lower needle cylinder 5 and the upper needle cylinder 8, as regards the needles and the elements designed to actuate the needles, can be provided in a per se known manner. These element, as well as the other elements of the machine that are of a known type and in any case are not related to the subject of the present invention, are not described although they are illustrated.

The column 6 is fixed, at its lower end, to the upper face of the footing 3 and supports, so that it can rotate about the axis 12 of the main shaft 11, the arm 13 by means of a pair of bearings 16.

The arm 13 supports, so that it can rotate about the corresponding axis 7, the upper needle cylinder 8 by means of another pair of bearings 17.

The main shaft 11 is supported by the column 6 by means of a pair of bearings 18. The main shaft 11 protrudes, with its lower end, from the lower end of the column 6 and protrudes, with its upper end, from the upper end of the column 6.

Conveniently, the machine comprises first locking means 19 to lock the rotation of the upper needle cylinder 8 about its own axis 7 with respect to the arm 13. The first locking means 19 can be activated on command in order to cause the rotation of the arm 13 about the axis 12 of the main shaft 11 with respect to the column 6 by means of the actuation of the main shaft 11 with a rotary motion about its own axis 12, performed by the main motor 10, as will become better apparent hereinafter.

The main shaft 11 is connected kinematically to the upper needle cylinder 8 by means of a transmission which comprises at least one sprocket or pulley 27, which is keyed around the upper needle cylinder 8. The first locking means 19 comprise a movable key 20, which is supported by the arm 13 and can move on command from an inactive position, in which it does not interfere with the sprocket or pulley 27, to a locking position, in which it engages a slot 21 provided in the body of the sprocket or pulley 27.

In greater detail, a first toothed pulley 22 is keyed around the end portion of the main shaft 11 that protrudes downward from the column 6 and is connected, by means of a first toothed belt 23, to a second toothed pulley 24, which is keyed around a portion of the lower needle cylinder 5. A third toothed pulley 25 is keyed around the end portion of the main shaft 11 that protrudes upward from the column 6 and is connected, by means of a second toothed belt 26, to a fourth toothed pulley 27, which is keyed around a portion of the upper needle cylinder 8.

The movable key 20 is connected to the stem of a first fluid-operated cylinder 28, which is connected by means of its body within the arm 13 and is oriented with the axis of its piston radially with respect to the axis 12 of the main shaft 11. The movable key 20 faces, with one of its ends, the slot 21 provided radially in a portion of the body of the fourth toothed pulley 27. In practice, the engagement of the movable key 20 with the slot 21 couples the fourth toothed pulley 27 to the arm 13 as regards the rotation about the axis 12 of the main shaft 11.

Advantageously, second means 29 are provided for locking the rotation of the arm 13 about the axis 12 of the main shaft 11 with respect to the column 6.

The second locking means 29 comprise a pin 30, with an axis 31 which is parallel to the axis 12 of the main shaft 11, which is supported by the arm 13 and can move on command from an inactive position, in which it does not interfere with the column 6, to a locking position, in which it engages a first seat 32 defined by the column 6. The first seat 32 is aligned with the pin 30 when the upper needle cylinder 8 is perfectly coaxial to the lower needle cylinder 5.

The pin 30 is provided monolithically with the stem of the piston of a second fluid-operated cylinder 33, which is provided in a portion of the arm 13.

Conveniently, in the column 6, in a region which is angularly spaced with respect to the first seat 32 around the axis 12 of the main shaft 11, a second seat 43 is provided, with which the pin 30 can engage after the arm 13 has been rotated about the axis 12 with respect to the column 6, moving the upper needle cylinder 8 laterally to the lower needle cylinder 5.

Conveniently, means 34 are provided for adjusting the coaxial arrangement between the upper needle cylinder 8 and the lower needle cylinder 5 following the engagement of the pin 30 with the first seat 32. The adjustment means 34 comprise an eccentric pin 35 with rollers which is connected to the column 6 and defines, with its outer lateral surface, a resting contact region for a side of the pin 30 along a direction which is horizontal and perpendicular to a direction which is radial with respect to the axis 12 of the main shaft 11. In practice, by rotating the eccentric pin 35 about its own axis 36, with the pin 30 engaged in the first seat 32, it is possible to vary the rotational position of the arm 13 around the axis 12 of the main shaft 11 with respect to the column 6 and it is therefore possible to lock the upper needle cylinder 8 in a position which is perfectly coaxial to the lower needle cylinder 5 and maintain this coaxial arrangement during the normal operation of the machine, i.e., during the forming of a manufacture.

Conveniently, means 37 are provided for detecting the pin 30 in the locking position, i.e., the correct engagement of the pin 30 with the first seat 32. The detection means 37 can be constituted by a sensor 38 of a known type, which is arranged on the bottom of the first seat 32 and is adapted to abut against the end of the pin 30 that is inserted in the first seat 32.

Advantageously, the main shaft 11 is the shaft of the main motor 10, which is constituted by an electric motor accommodated in the column 6

Even more preferably, the column 6 constitutes the enclosure of the main motor 10.

Figure 3:
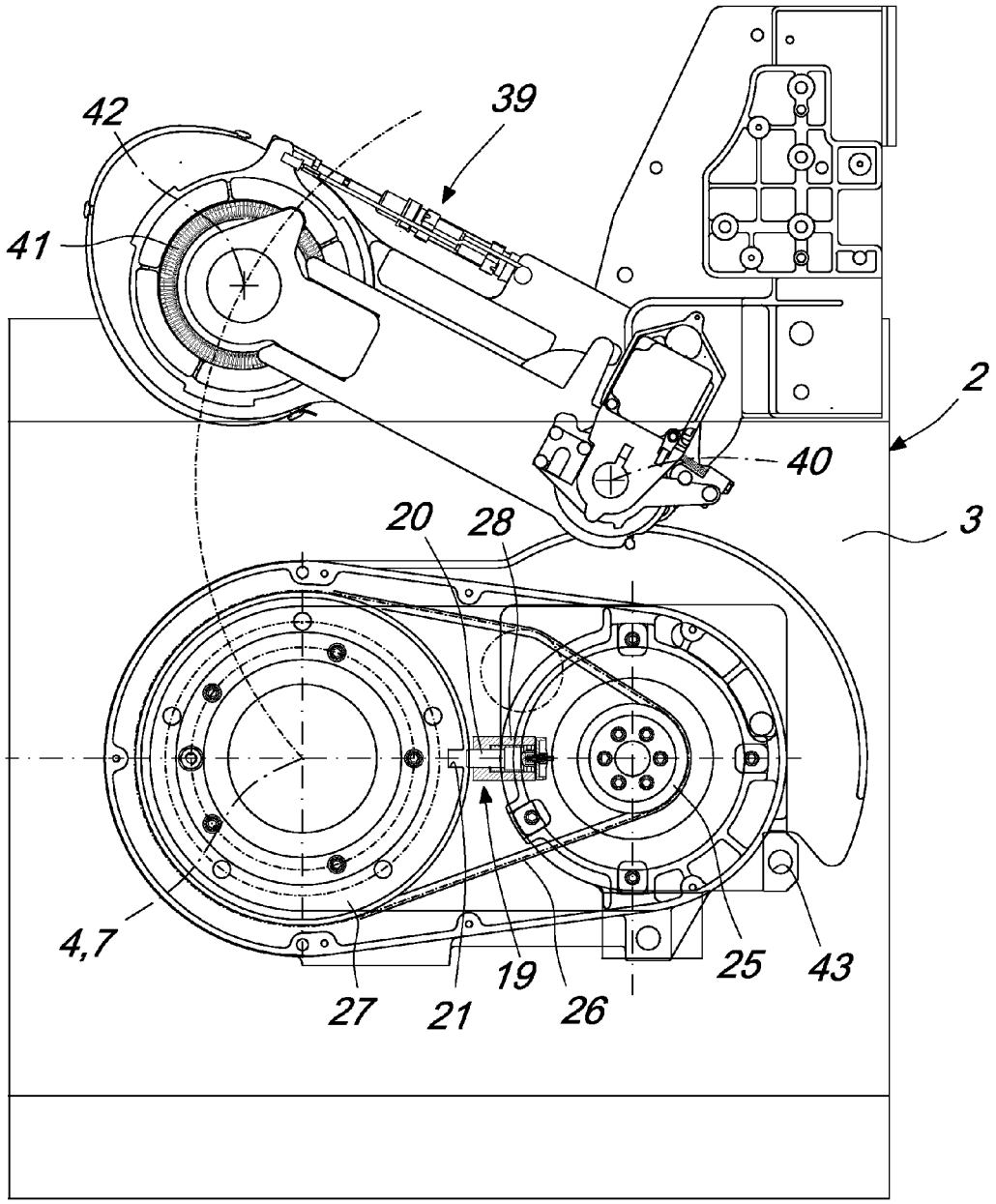
FIG. 3 is a schematic sectional view of the machine according to the invention, taken along the line III-III of FIG. 2, with the upper needle cylinder arranged coaxially to the lower needle cylinder and showing a pick-up device arranged laterally to the machine.
Figure 4:
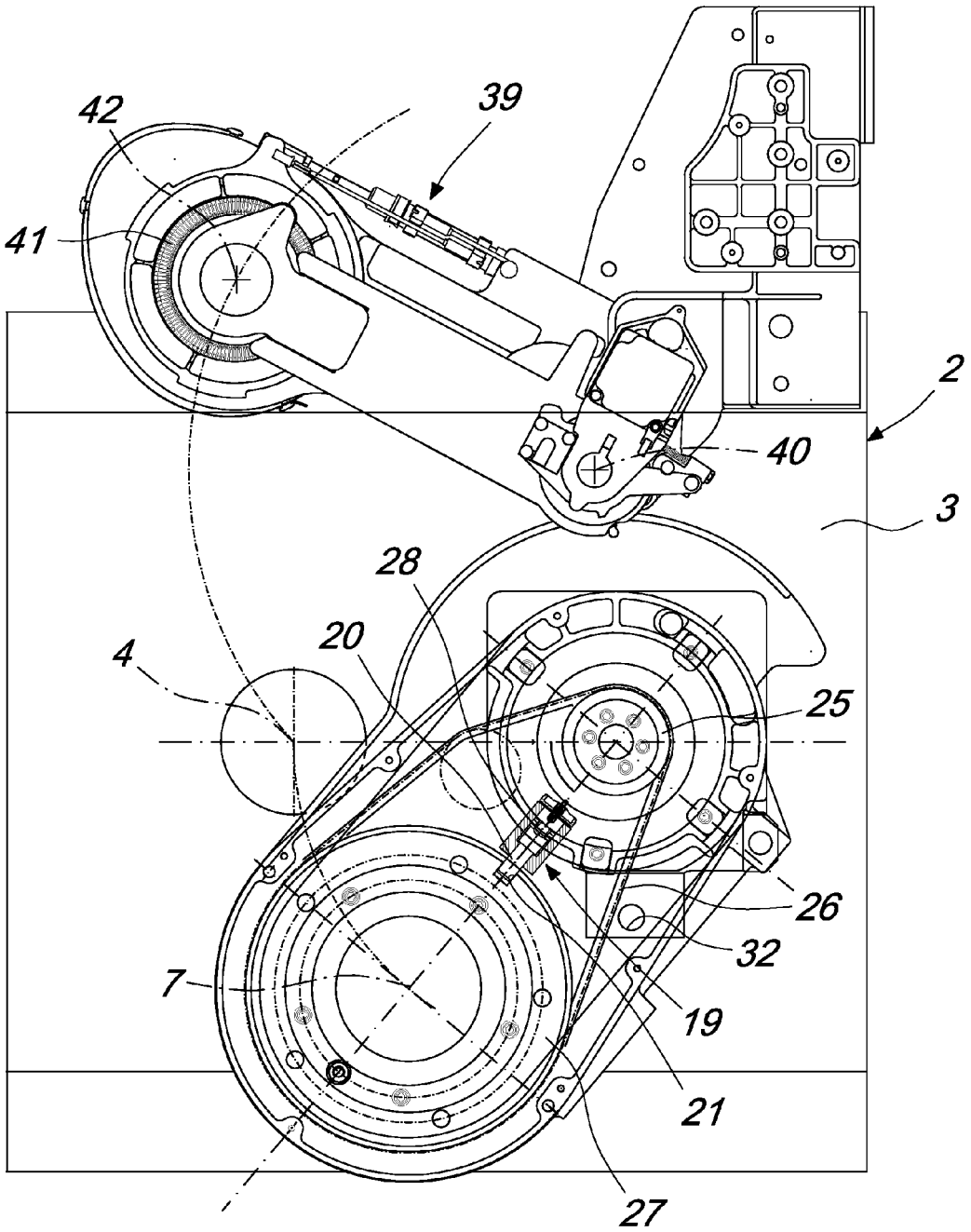
FIG. 4 is a schematic sectional view of the machine according to the invention, as in FIG. 3, with the upper needle cylinder shifted laterally with respect to the lower needle cylinder, shown only schematically.

For the sake of completeness in description, it should be noted that FIGS. 3 and 4 are top plan views of a pick-up device 39 which is supported, so that it can rotate about a vertical axis 40, which is spaced laterally with respect to the axis 12 of the main shaft 11, by the footing 3. The pick-up device 39 is provided with an annular element 41, which is oriented so that its axis 42 is vertical and supports a plurality of pick-up elements, each of which can engage the needles of the machine in order to perform pick-up of the manufacture. The pick-up device 39 can be a pick-up device of the type disclosed in WO2009/112346 and WO2009/112347. The pick-up device 39, by means of the rotation about the axis 40 with respect to the footing 3 of the machine, can be moved with its annular element 41 above and coaxially with respect to the lower needle cylinder 5 or can be positioned in a sewing or looping station arranged laterally to the machine, in which the manufacture, once removed from the machine, can be subjected to a sewing or looping operation in order to close one of its axial ends, for example as described in the above mentioned international patent applications.

Operation of the machine according to the invention is as follows.

Figure 2:
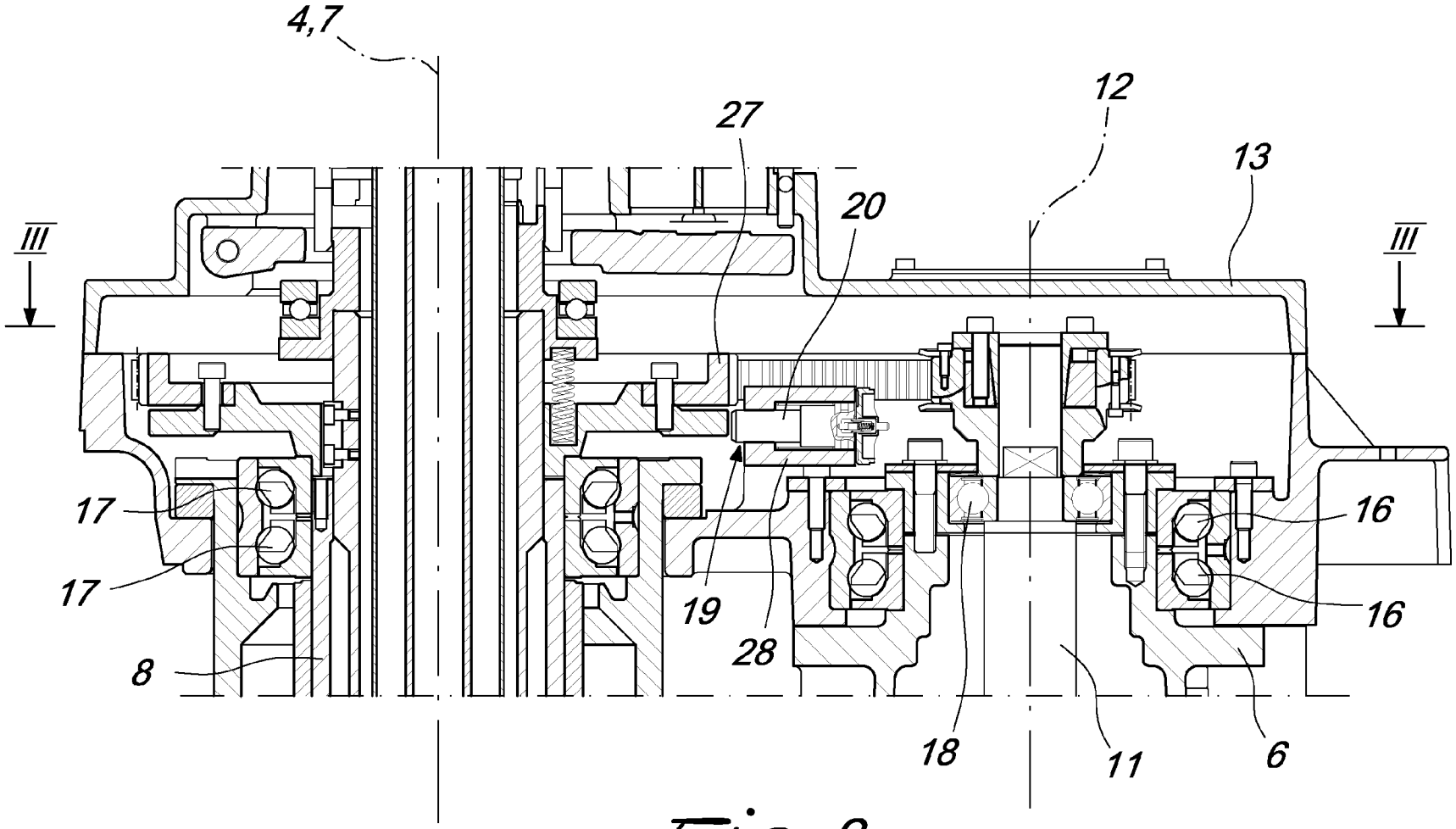
FIG. 2 is an enlarged-scale view of a detail of FIG. 1.
Figure 5:
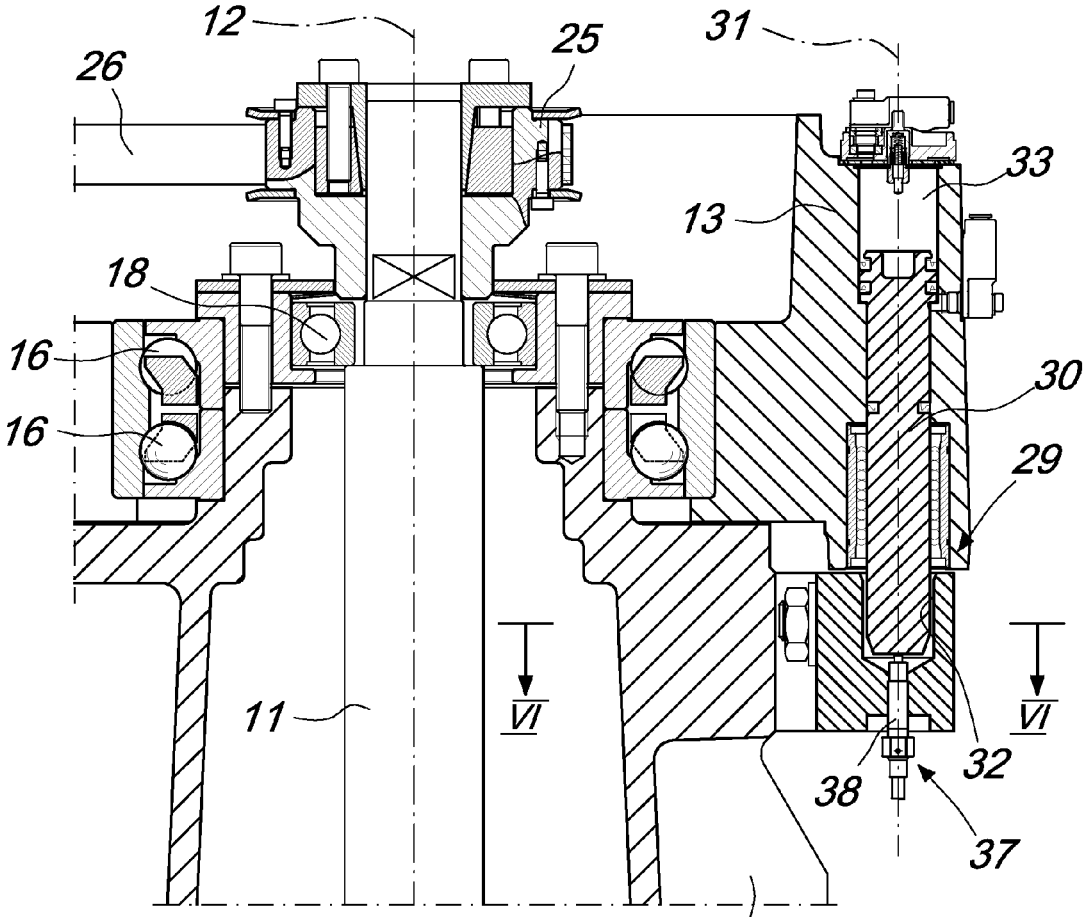
FIG. 5 is an enlarged-scale sectional view of a detail of the machine, taken along a vertical plane that passes through the axis of the main shaft.
Figure 6:
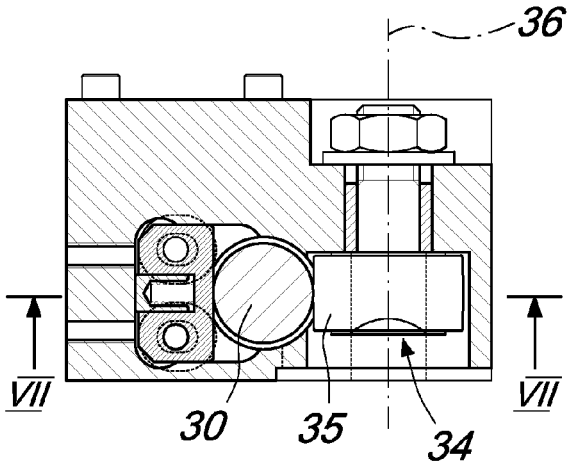
FIG. 6 is an enlarged-scale sectional view of FIG. 5, taken along the line VI-VI.
Figure 7:
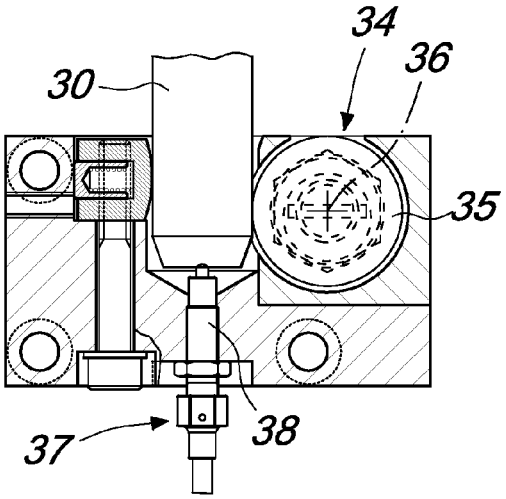
FIG. 7 is a schematic sectional view of FIG. 6, taken along the line VII-VII, with some elements not shown in cross-section.

During the production of a manufacture, the upper needle cylinder 8 is arranged above and coaxially with respect to the lower needle cylinder 5 and the movable key 20 is disengaged from the slot 21, as shown in FIGS. 1, 2 and 3, so that the actuation of the main motor 10 causes, simultaneously and in a mutually synchronized manner, the actuation of the lower needle cylinder 5 and of the upper needle cylinder 8 with a rotary motion about the common axis 4, 7 with respect to the supporting structure 2 of the machine. In this condition, the coaxial arrangement between the lower needle cylinder 5 and the upper needle cylinder 8 is ensured by the engagement of the pin 30 with the first seat 32, as shown in FIGS. 5, 6 and 7.

When one wishes to move the upper needle cylinder 8 laterally with respect to the axis 4 of the lower needle cylinder 5, after first stopping the main motor 10, the first fluid-operated cylinder 28 is actuated so as to cause engagement of the movable key 20 with the slot 21 and then the second fluid-operated cylinder 33 is actuated so as to disengage the pin 30 from the first seat 32. In this condition, the upper needle cylinder 8 is integral, as regards rotation about the axis 12 of the main shaft 11, with the arm 13, which is no longer locked with respect to the column 6 as regards rotation about the same axis 12 of the main shaft 11. As shown in FIG. 4, by actuating the main motor 10 the main shaft 11 is turned and therefore, as a consequence of the kinematic connection provided by the second toothed belt 26, the arm 13 is made to rotate about the axis 12 of the main shaft 11 with respect to the column 6 through a preset angle, which can be preset in the actuation of the main motor 10, if the motor allows precise control of the rotation of its axis, as in modern electric motors, and can be optionally limited by mechanical stop elements, not shown for the sake of simplicity. With the upper needle cylinder 8 shifted laterally with respect to the axis 4 of the lower needle cylinder 5, the pin 30 is engaged with the second seat 43, with which it is aligned, so as to prevent safely the possibility that the arm 13 might be rotated about the axis 12.

With the upper needle cylinder 8 shifted laterally to the axis 4 of the lower needle cylinder 5, it is possible to arrange above the lower needle cylinder 5 a pick-up device 39 for performing the automated pick-up of the manufacture that is retained, with the loops of the last formed row of knitting, on the needles arranged in the lower needle cylinder 5, for example as disclosed in WO2009/112346 and WO2009/112347.

Once the upper needle cylinder 8 has been moved laterally to the axis 4 of the lower needle cylinder 5, the movable key 20 can be disengaged from the slot 21 so as to make it possible to use the main motor 10 to actuate the needle cylinders 5, 8, in particular the lower needle cylinder 5, in order to perform other operations, for example to actuate the needles arranged in the lower needle cylinder 5 during the transfer of the manufacture to the pick-up device 39.

After the pick-up device 39, with the manufactured article, has been moved away from the machine, the movable key 20 is again engaged with the slot 21, the pin 30 is disengaged from the second seat 43 and the main motor 10 is again actuated, with an opposite direction of rotation with respect to the preceding one, so as to cause the rotation of the arm 13 about the axis 12 of the main shaft 11 with respect to the column 6, consequently returning the upper needle cylinder 8 above and coaxially with respect to the lower needle cylinder 5.

Once the upper needle cylinder 8 has been arranged coaxially to the lower needle cylinder 5, the second fluid-operated cylinder 33 is actuated and, by engaging the pin 30 within the first seat 32, rigidly couples the arm 13 to the column 6 and therefore again ensures the coaxial arrangement between the needle cylinders 5, 8. Finally, the movable key 20 is disengaged from the slot 21.

In practice it has been found that the machine according to the invention fully achieves the intended aim and objects, since it makes it possible to move simply and precisely the upper needle cylinder laterally to the lower needle cylinder in particular to allow the arrangement, above the lower needle cylinder, of a pick-up device for the automated pick-up of the manufactured article at the end of its production.

A further advantage of the machine according to the invention, which arises from the fact that in order to move the upper needle cylinder laterally to the axis of the lower needle cylinder it uses the same main motor that actuates the needle cylinders of the machine, is that it avoids the use of additional devices which might hinder the other devices with which the machine is equipped.

The machine thus conceived is susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2011A001681 from which this application claims priority are incorporated herein by reference.

The invention claimed is:

1. A double-cylinder circular machine for producing tubular knitted manufactures comprising:

a supporting structure, which is provided with a footing for resting on the ground which supports, so that said supporting structure rotates about said supporting structure's own vertically-oriented axis; said supporting structure further comprising at least one column which is extended substantially vertically, protrudes upward from said footing, and supports, so that said supporting structure rotates about said supporting structure's own axis;

a lower needle cylinder;

an upper needle cylinder, which is arranged above said lower needle cylinder;

a main motor actuating said lower cylinder and said upper needle cylinder with a rotary motion about their axes; said main motor being connected kinematically to said lower needle cylinder and to said upper needle cylinder by a main shaft, which is arranged within said column and is oriented so that the main shaft's axis is vertical;

wherein said upper needle cylinder is supported so that said upper needle cylinder rotates about its own axis by an arm, which in turn is supported by said column so that said upper needle cylinder rotates about the axis of said main shaft; said arm rotating about the axis of said main shaft with respect to said column for the transition of said upper needle cylinder from an active position, in which said upper needle cylinder is arranged coaxially to said lower needle cylinder, to an inactive position, in which said upper needle cylinder is spaced with its axis laterally to the axis of said lower needle cylinder, and vice versa, said rotation means being affected by said motor.

2. The machine according to claim 1, comprising a movable key for locking the rotation of said upper needle cylinder about said upper needle cylinder's own axis with respect to said arm, said movable key being activatable on command for the rotation of said arm about the axis of said main shaft with respect to said column upon the actuation of said main shaft with a rotary motion about said main shaft's own axis.

3. The machine according to claim 2, wherein said main shaft is connected kinematically to said upper needle cylinder by a transmission, which comprises at least one sprocket or pulley which is keyed around said upper needle cylinder, said movable key, being supported by said arm and movable from an inactive position, in which said movable key does not interfere with said sprocket or pulley, to a locking position, in which said movable key is engaged with a slot provided in the body of said sprocket or pulley.

4. The machine according to claim 2, further comprising a pin for locking the rotation of said arm about the axis of said main shaft with respect to said column.

5. The machine according to claim 4, wherein said pin, which is supported by said arm and moves from an inactive position, in which said pin does not interfere with said column, to a locking position, in which said pin engages a first seat defined in said column, said first seat being aligned with said pin when said upper needle cylinder is coaxial to said lower needle cylinder.

6. The machine according to claim 5, further comprising a sensor for detecting said pin in said locking position.

7. The machine according to claim 2, wherein said main shaft is the shaft of said main motor.

8. The machine according to claim 2, wherein said main motor is an electric motor, and said column constitutes the enclosure of said electric motor.

9. The machine according to claim 2, wherein said main shaft protrudes downward from said column with its lower end and is connected to said lower needle cylinder by a first toothed belt, which mutually connects a first toothed pulley, which is keyed on the lower end of said main shaft, and a second toothed pulley, which is keyed around the lower end of said lower needle cylinder, said main shaft protruding upward from said column with its upper end and being connected to said upper needle cylinder by a second toothed belt, which mutually connects a third toothed pulley, which is keyed to the upper end of said main shaft, and a fourth toothed pulley, which is keyed around the upper end of said upper needle cylinder, said movable key being engageable with a slot defined within the body of said fourth toothed pulley.

10. The machine according to claim 2, further comprising an eccentric pin for adjusting the coaxial arrangement between said lower needle cylinder and said upper needle cylinder.

* * * * *